US005888138A

United States Patent [19]

Suganuma

[11] Patent Number: 5,888,138

[45] Date of Patent: Mar. 30, 1999

[54] MOVABLE MODEL OBJECT FOR USE IN GAMES

[75] Inventor: Masanori Suganuma, Kanagawa-ken, Japan

[73] Assignee: Konami Co., Ltd., Hyogo-ken, Japan

[21] Appl. No.: 923,077

[22] Filed: Sep. 3, 1997

[30] Foreign Application Priority Data

Sep. 10, 1996 [JP] Japan ..... 8-239566

[51] Int. Cl.[6] ..... A63F 9/14

[52] U.S. Cl. ..... 462/68; 446/277; 446/332; 446/449; 446/285; 446/356

[58] Field of Search ..... 463/58, 61, 62, 463/64–69; 446/313, 330, 332, 279, 277, 280, 289, 290, 292, 376, 269, 448, 449, 431

[56] References Cited

U.S. PATENT DOCUMENTS

| | | | |
|---|---|---|---|
| 621,885 | 3/1899 | Wishart | 446/277 |
| 717,202 | 12/1902 | Hübsch . | |
| 1,043,808 | 11/1912 | Denman . | |
| 1,569,761 | 1/1926 | Lee | 446/277 |
| 1,613,408 | 1/1927 | Perew | 446/277 |
| 1,647,507 | 11/1927 | Cross . | |
| 2,036,328 | 4/1936 | Furey | 446/269 |
| 2,218,065 | 10/1940 | Berger . | |
| 2,457,865 | 1/1949 | Carmichael | 446/276 |
| 2,782,556 | 2/1957 | Otis . | |
| 3,118,247 | 1/1964 | Allen . | |
| 4,090,713 | 5/1978 | DeCesare | 463/62 |
| 4,561,514 | 12/1985 | Yamada | 446/276 X |
| 5,618,233 | 4/1997 | Iimura et al. | 463/67 |

FOREIGN PATENT DOCUMENTS

| | | |
|---|---|---|
| 516160A1 | 12/1992 | European Pat. Off. . |
| 702988A2 | 3/1996 | European Pat. Off. . |
| Nr.85621 | of 1895 | Germany . |
| 531044 | 12/1957 | Italy . |
| 1-152698 | 10/1989 | Japan . |
| 3009057 | 1/1995 | Japan . |

*Primary Examiner*—Raleigh W. Chiu
*Attorney, Agent, or Firm*—Jordan and Hamburg LLP

[57] ABSTRACT

A movable model object which resembles a racehorse has a model supported on a base having wheels that run on a field of a horse racing game apparatus. The model includes front and rear legs as movable elements and a power transmitting mechanism for transmitting rotation of the wheels to the front and rear legs. The power transmitting mechanism includes an endless belt for transmitting the rotation of the wheels to a rotatable shaft rotatably supported on a fixed frame of the model to move the front and rear legs.

22 Claims, 4 Drawing Sheets

MOVABLE MODEL OBJECT FOR USE IN GAMES

BACKGROUND OF THE INVENTION

1. Field of the Invention:

The present invention relates to a movable model object for use in games, and more particularly to a movable model object for use in various racing games which simulate races such as horse races, athletic track races, car races, bicycle races, motorcycle races, etc., on a game board which resembles a track.

2. Description of the Prior Art:

Heretofore, there have been known racing game apparatus having moving objects resembling racehorses, bicycles, athletes, cars, motorcycles, etc. which run along respective courses on a track-shaped game board to compete for higher ranks under the control of a computer. Game players who participate in racing games played on those racing game apparatus bet points or medals on favorite moving objects.

Those racing games employ movable model objects which are analogous to moving objects such as race horses, for example, that run in actual races. Japanese laid-open utility model publication No. 1-152698 and Japanese utility model registration No. 3009057, for example, disclose conventional movable model objects. Each of the disclosed movable model objects comprises a model horse device which simulates a racehorse and a jockey, and is used in a horse racing game apparatus.

The racehorse of the conventional movable model objects has front and rear legs that are swingable about their upper ends so as to be as similar to actual racehorses as possible in order to give the game player a realistic feeling when playing a horse race game.

The movable model object disclosed in Japanese laid-open utility model publication No. 1-152698 comprises a model horse mounted on a chassis movable on a field and having front and rear legs. The model horse is operatively coupled to a wheel shaft of the chassis through a crank, so that the model horse and the legs can swing when the chassis moves on the field.

More specifically, the model horse that is pivotally supported on the chassis is coupled to the wheel shaft by the crank and swing arms. When the chassis runs, the model horse is swung about its pivot by the crank and the swing arms, and the legs are also swung in response to the swinging motion of the model horse. Because the crank and the swing arms as they operate are visible to the game player, the game player clearly recognizes at all times that the model horse is being mechanically operated during the game. Therefore, the revealed movable model object does not look like an actual racehorse to the eyes of the game player, and is not aesthetically pleasing.

The movable model object disclosed in Japanese laid-open utility model publication No. 1-152698 is a four-legged movable model object comprising a model horse mounted on a movable body movable on a field by a support column. Rotation of a wheel shaft of the movable body is converted into rotation of a rotatable shaft in the support column and then into rotation of a main shaft that extends in the model horse parallel to the wheel shaft. The shaft in the model horse rotates an eccentric cam which causes the legs to swing about their upper ends.

More specifically, rotation of the wheel shaft of the movable body is transmitted to the rotatable shaft in the support column through gears, and rotation of the rotatable shaft is transmitted to the main shaft through a worm and a helical gear. In order to cause the various movable parts to move smoothly at a speed that is commensurate with the speed at which the model horse moves, it is necessary to reduce the rotational speed of the wheel shaft at suitable speed reduction ratios of the various gears. The speed reduction ratios, which depend on the sizes and combinations of the gears, cannot easily be selected and established due to limitations on the space that is available for the gears in the four-legged movable model object. Each of the legs comprises upper and lower leg members operatively connected to each other such that the lower leg member can move relatively to the upper leg member in response to movement of the upper leg member. The structure of each of the legs is made up of a number of components and is highly complex. Consequently, the legs cannot easily be assembled in a short period of time, and hence the rate of production of the legs is poor.

SUMMARY OF THE INVENTION

It is therefore an object of the present invention to provide a movable model object for use in games which has a power transmitting mechanism for transmitting rotation of wheels on a base movable on a field to movable elements without many gears, is aesthetically pleasing, includes a movable element operating mechanism, which is relatively simple and made up of a relatively small number of parts, for moving the movable elements in response to the rotation transmitted by the power transmitting mechanism, can be assembled efficiently with ease, and can be manufactured relatively inexpensively.

According to the present invention, a movable model object for use in a game having a field includes a base having at least one wheel movable on the field and a model supported on the base, the model having a fixed frame, a rotatable shaft rotatably supported on the fixed frame, movable elements independently movably supported on the fixed frame. A power transmitting mechanism which transmits rotation of the wheel to the movable elements through the rotatable shaft comprises an endless belt for transmitting the rotation of the wheel to the rotatable shaft to move the movable elements. The power transmitting mechanism may further comprise at least one eccentric cam disk mounted on the rotatable shaft and at least one sector plate having pivotally connected at an end thereof to the fixed frame and an arcuate angular movement transmitting member at an opposite end thereof for transmitting angular movement to the movable elements, the eccentric cam disk being held in contact with the sector plate for angularly moving the sector plate to angularly move the movable elements in response to rotation of the rotatable shaft.

Since the endless belt is used to transmit rotation from the wheel to the rotatable shaft for moving the movable elements, the movable model object is free of the difficulty in selecting and establishing speed reduction ratios which would otherwise be required for movable model objects having many gears. Because movement of the endless belt is less visually recognizable than gears, the movable model object is relatively aesthetically pleasing to the eye.

The model may be analogous in shape to an animal, and each of the movable elements may comprise front and rear legs of the animal. Each of the front and rear legs has an upper leg member and a lower leg member pivotally connected to a lower end of the upper leg member. The movable model object may further comprise a leg operating mechanism for moving the upper leg members and the lower leg members of the front and rear legs. The leg operating mechanism may comprise a rotatable body connected to an upper end of each of the upper leg members and angularly movable back and forth through a predetermined angular range in response to the rotation transmitted by the power transmitting mechanism, a lower leg member operating link connected to an upper end of each of the lower leg members, and a joint operatively connecting an upper end of the lower leg member operating link to the fixed frame.

The joint may comprise a slot defined in the lower leg member operating link and a pin mounted on the fixed frame and inserted in the slot. The pin is spaced from an axis about which the upper leg member is angularly movable.

The upper and lower leg members of the front and rear legs are moved with respect to each other through a relatively simple structure including the pin and the lower leg member operating link. Consequently, the upper and lower leg members of the front and rear legs are moved highly reliably with respect to each other. The number of parts that make up the leg operating mechanism and hence the movable model object is relatively small, can be assembled efficiently with relative ease, and can be manufactured relatively inexpensively.

According to the present invention, a movable model object for use in a game having a field includes a base, a model, a power transmitting mechanism, which are identical to those described above, and a movable element operating mechanism for operating the movable elements in response to the rotation transmitted by the power transmitting mechanism. The movable element operating mechanism comprises a rotatable body connected to an upper end of each of the movable elements and angularly movable back and forth through a predetermined angular range in response to the rotation transmitted by the power transmitting mechanism, a movable element operating link connected to an upper end of each of the movable elements, and a joint operatively connecting an upper end of the movable element operating mechanism to the fixed frame. The joint may comprise a slot defined in the lower leg member operating link and a pin mounted on the fixed frame and inserted in the slot. The pin is spaced from an axis about which the rotatable body is rotatable.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

The principles of the present invention are particularly useful when embodied in a movable model object such as a model racehorse used in a horse racing game apparatus.

Figure 2:
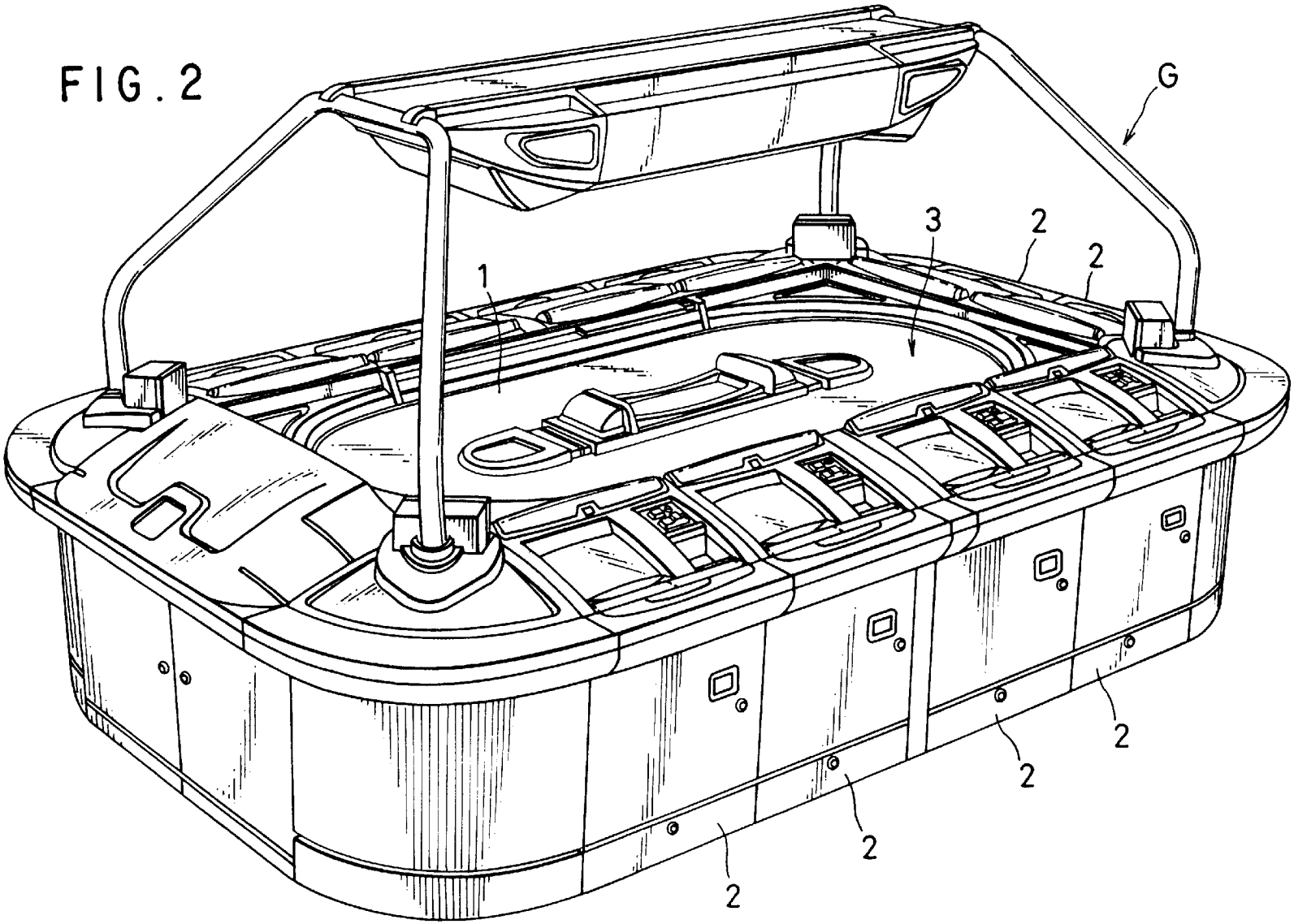
FIG. 2 is a side elevational view of the movable model object according to the present invention.

FIG. 2 shows in perspective a horse racing game apparatus G which employs the movable model object according to the present invention.

As shown in FIG. 2, the horse racing game apparatus G generally comprises a central table 3 having a field 1 on its upper surface and a plurality of player's consoles 2, four disposed along each of two opposite longitudinal sides of the central table 3 and two disposed along one of two opposite transverse sides of the central table 3.

A movable model object 10 (see FIG. 1) according to the present invention runs on the field 1 of the horse racing game apparatus G.

Figure 1:
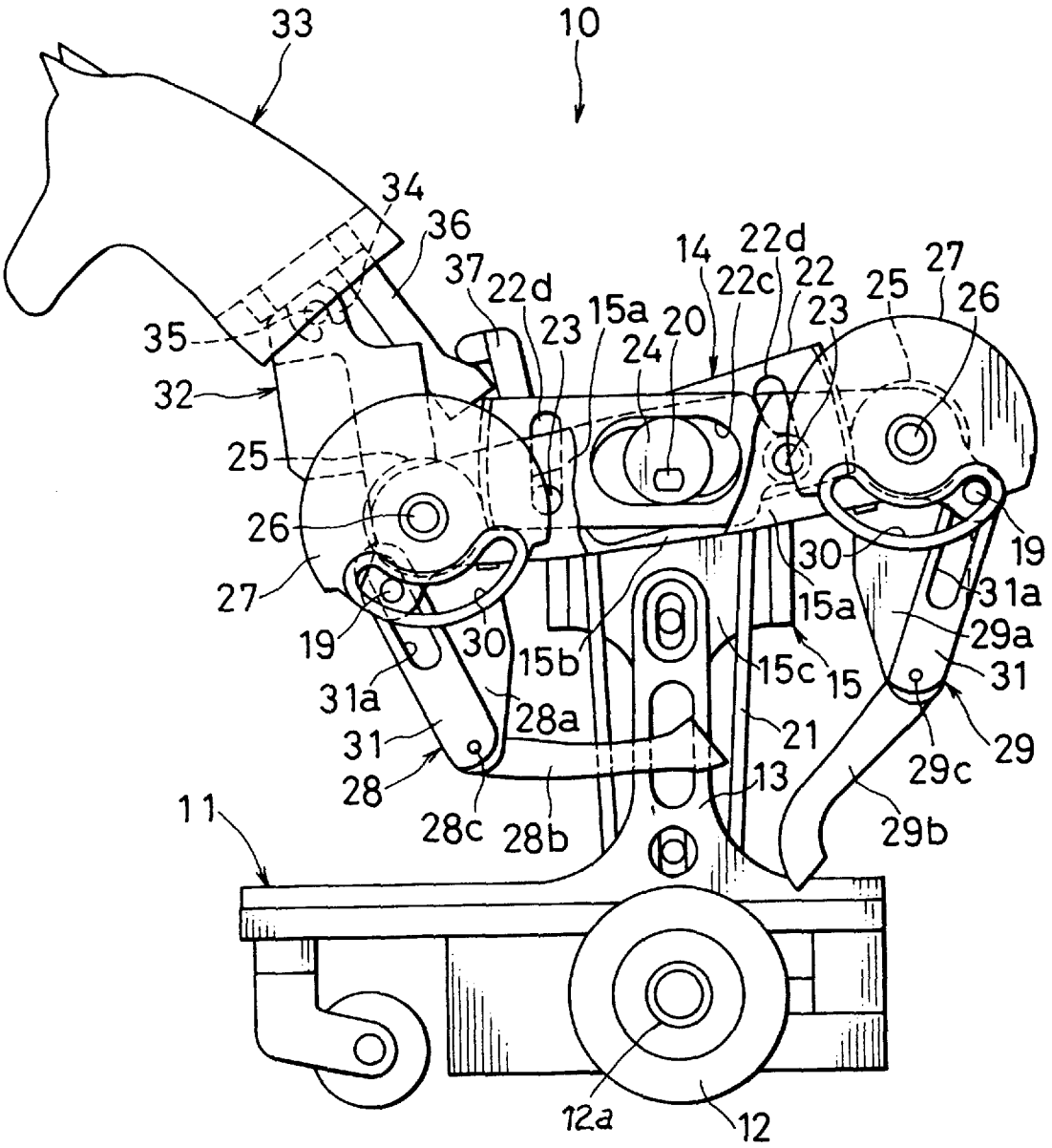
FIG. 1 is a perspective view of a horse racing game apparatus which incorporates a movable model object according to the present invention.

As shown in FIG. 1, the movable model object 10 generally comprises a base 11 having two wheels 12 disposed one on each side thereof and interconnected by a wheel shaft 12*a* and a model 14 supported by a vertical support column 13 mounted on a substantially central upper surface of the base 11. The wheel shaft 12*a* supports a pulley (not shown) fixedly mounted thereon. The model 14 simulates a racehorse, and its surrounding cover and decorative components are omitted from illustration.

Figure 3:
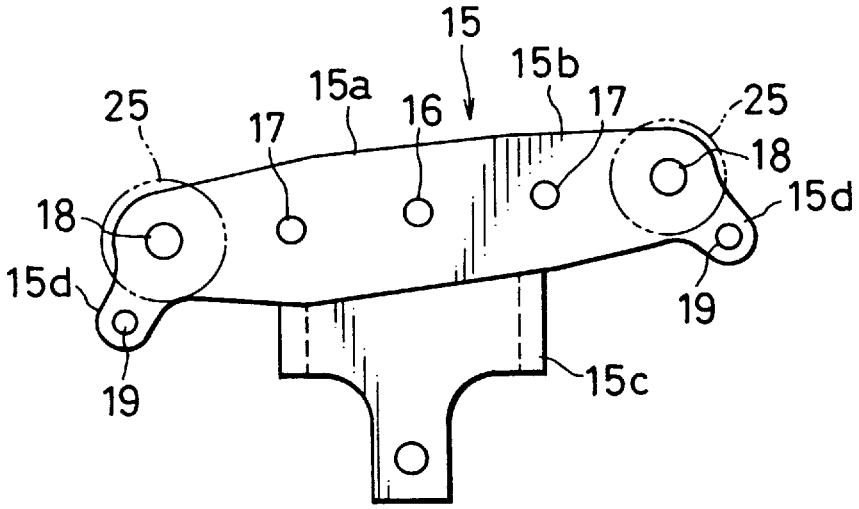
FIG. 3 is a front elevational view of a fixed frame of the movable model object shown in FIG. 2.

The model 14 has a fixed frame 15 fixedly mounted on the vertical support column 13. As shown in FIG. 3, the fixed frame 15 mainly comprises two horizontally spaced side plates 15*a*, 15*b* and two attachment columns 15*c* extending downwardly from lower edges of the respective side plates 15*a*, 15*b* and joined to each other. The attachment columns 15*c* are connected to the vertical support column 13. The side plate 15*a*, which is closer to the viewer in FIG. 1, is shown broken away in its central portion in FIG. 1.

As shown in FIG. 3, each of the two horizontally spaced side plates 15*a*, 15*b* has a shaft attachment hole 16 defined in its longitudinally central portion and two shaft attachment holes 17 defined in respective portions thereof one on each side of the longitudinally central portion.

Each of the two horizontally spaced side plates 15*a*, 15*b* also has shaft reception holes 18 defined in respective longitudinally opposite ends thereof. One of the longitudinally opposite ends which is the left-hand end in FIG. 3 is referred to as a "front end" whereas the other longitudinally opposite end which is the right-hand end in FIG. 3 is referred to as a "rear end". Furthermore, each of the two horizontally spaced side plates 15*a*, 15*b* has arms 15*d* integrally projecting obliquely downwardly outwardly from the respective front and rear ends thereof. Pins 19 are fixed respectively to the distal ends of the arms 15*d*.

A rotatable shaft 20 extends horizontally across the gap between the side plates 15*a*, 15*b* and has opposite ends rotatably supported in the respective shaft attachment holes 16. The rotatable shaft 20 supports a pulley (not shown) fixedly mounted on an axially intermediate portion thereof. An endless belt 21 is trained around the pulley on the wheel shaft 12*a* and the pulley on the rotatable shaft 20 for transmitting rotation of the wheel shaft 12*a* to the rotatable shaft 20.

Figure 4:
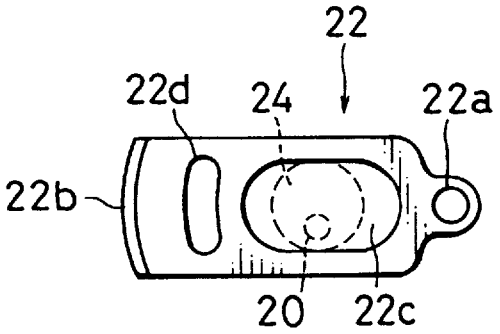
FIG. 4 is a front elevational view of a sector plate of the movable model object shown in FIG. 2.

There are four sector plates 22 disposed parallel to each other between the side plates 15*a*, 15*b*, two on one side of the pulley on the rotatable shaft 20 and two on the other side thereof. The four sector plates 22 are identical in shape to each other, and one of them is illustrated in FIG. 4. Each of the sector plates 22 comprises a thin plate having a generally elongate rectangular shape, and has a circular hole 22*a* defined in a longitudinal end thereof.

Each of the sector plates 22 has an arcuate rack 22*b* defined on the other longitudinal end thereof and having a center of curvature at the hole 22*a*, and a relatively large horizontally elongate opening 22*c* defined centrally therein between the hole 22*a* and the rack 22*b*. An arcuate vertical slot 22*d* is defined in each of the sector plates 22 between the opening 22*c* and the rack 22*b* and has a center of curvature at the hole 22*a*.

The four sector plates 22 serve to move movable elements of the model 14, i.e., front legs 28 and rear legs 29, based on the rotation transmitted from the wheel shaft 12*a* to the rotatable shaft 20 through the endless belt 21. Two of the four sector plates 22 are oriented such that their racks 22*b* are directed to the left in FIG. 1, i.e., to the front of the model 14, and the remaining two of the four sector plates 22 are oriented such that their racks 22*b* are directed to the right in FIG. 1.

A support shaft 23 extends through the holes 22*a* of two identically oriented sector plates 22, and another support shaft 23 extends through the holes 22*a* of the other two identically oriented sector plates 22. These support shafts 23 have their opposite ends fixedly inserted in the respective shaft attachment holes 17 in the side plates 15*a*, 15*b*.

Each of the support shafts 23 that serves as a shaft about which two identically oriented sector plates 22 are angularly movable extends through the vertical arcuate slots 22*d* in the other two identically oriented sector plates 22. Therefore, angular movement of one of the sets of two identically oriented sector plates 22 is not obstructed by the support shaft 23 which serves as a shaft about which the other set of two identically oriented sector plates 22 is angularly movable.

When the four sector plates 22 are juxtaposed between the side plates 15*a*, 15*b*, the openings 22*c* defined therein are held in substantial registry with each other. Stated otherwise, the openings 22*c* defined in the four sector plates 22 are positioned such that they are held in substantial registry with each other when the four sector plates 22 are juxtaposed between the side plates 15*a*, 15*b*. The rotatable shaft 20 extends through the openings 22*c*.

The rotatable shaft 20 supports four eccentric cam disks 24 fixedly mounted thereon and positioned in the respective openings 22*c*, the eccentric cam disks 24 being angularly displaced relatively to the rotatable shaft 20 by different angles or phases. When the rotatable shaft 20 rotates, the eccentric cam disks 24 rotate, causing the respective sector plates 22 to swing about the respective support shafts 23. The endless belt 21, the sector plates 22, and the eccentric cam disks 24 jointly serve as a power transmitting mechanism.

A leg operating mechanism is disposed in each of the front and rear ends of the side plates 15*a*, 15*b*. The leg operating mechanism operates in response to the rotation of the wheels 12 which is transmitted through the power transmitting mechanism. The leg operating mechanism includes four gears 25 (see FIGS. 1 and 3) disposed within the front and rear ends of the side plates 15*a*, 15*b*.

The four gears 25 are held in mesh with the respective arcuate racks 22*b* of the sector plates 22. The gears 25 have respective short central shafts 26 projecting laterally from one side thereof. The shafts 26 extend through the respective shaft reception holes 18 in the front and rear ends of the side plates 15*a*, 15*b*, project outwardly through the side plates 15*a*, 15*b*, and are fixed centrally to respective disks 27 that are disposed outwardly of the side plates 15*a*, 15*b*.

When the gears 25 are angularly moved back and forth about the shafts 26 by the swinging sector plates 22, the disks 27 are also angularly moved back and forth in unison with the gears 25. The front and rear legs 28, 29 have respective upper leg members 28*a*, 29*a* which are integral with and extend radially outwardly from circumferential edges of the disks 27.

The disks 27 have respective arcuate slots 30 defined therein along the circumferential edges of the disks 27. The pins 19 on the arms 15*d* at the front and rear ends of the side plates 15*a*, 15*b* project through the arcuate slots 30. The slots 30 have a length corresponding to an angular displacement which the disks 27 make when they are angularly moved back and forth by the sector plates 22. As a result, the pins 19 do not interfere with the disks 27 as they make such an angular displacement.

The front and rear legs 28, 29 also have respective lower leg members 28*b*, 29*b* whose lower ends serve as hooves. The upper ends of the lower leg members 28*b*, 29*b* are pivotally connected to respective lower ends of the upper leg members 28*a*, 29*a* by pivot shafts 28*c*, 29*c* as joints.

Lower leg member operating links 31 have lower ends joined to the respective pivot shafts 28*c*, 29*c* such that the lower leg member operating links 31 and the lower leg members 28*b*, 29*b* are angularly displaced from each other.

The lower leg members 28*b*, 29*b* and the lower leg member operating links 31 are integrally joined to each other by the pivot shafts 28*c*, 29*c* for angular movement with respect to the upper leg members 28*a*, 29*a*. The lower leg member operating links 31 have respective slots 31*a* defined longitudinally in upper end portions thereof and receiving the pins 19, respectively.

A head attachment 32 is fixed to the front end of the fixed frame 15. The model 14 includes a head 33, which resembles the head of a racehorse, having a C-shaped hook 34 on a lower end thereof. The hook 34 is press-fitted over a support shaft 35 on an upper end of the head attachment 32, thereby connecting the head 33 pivotally to the head attachment 32.

Figure 5:
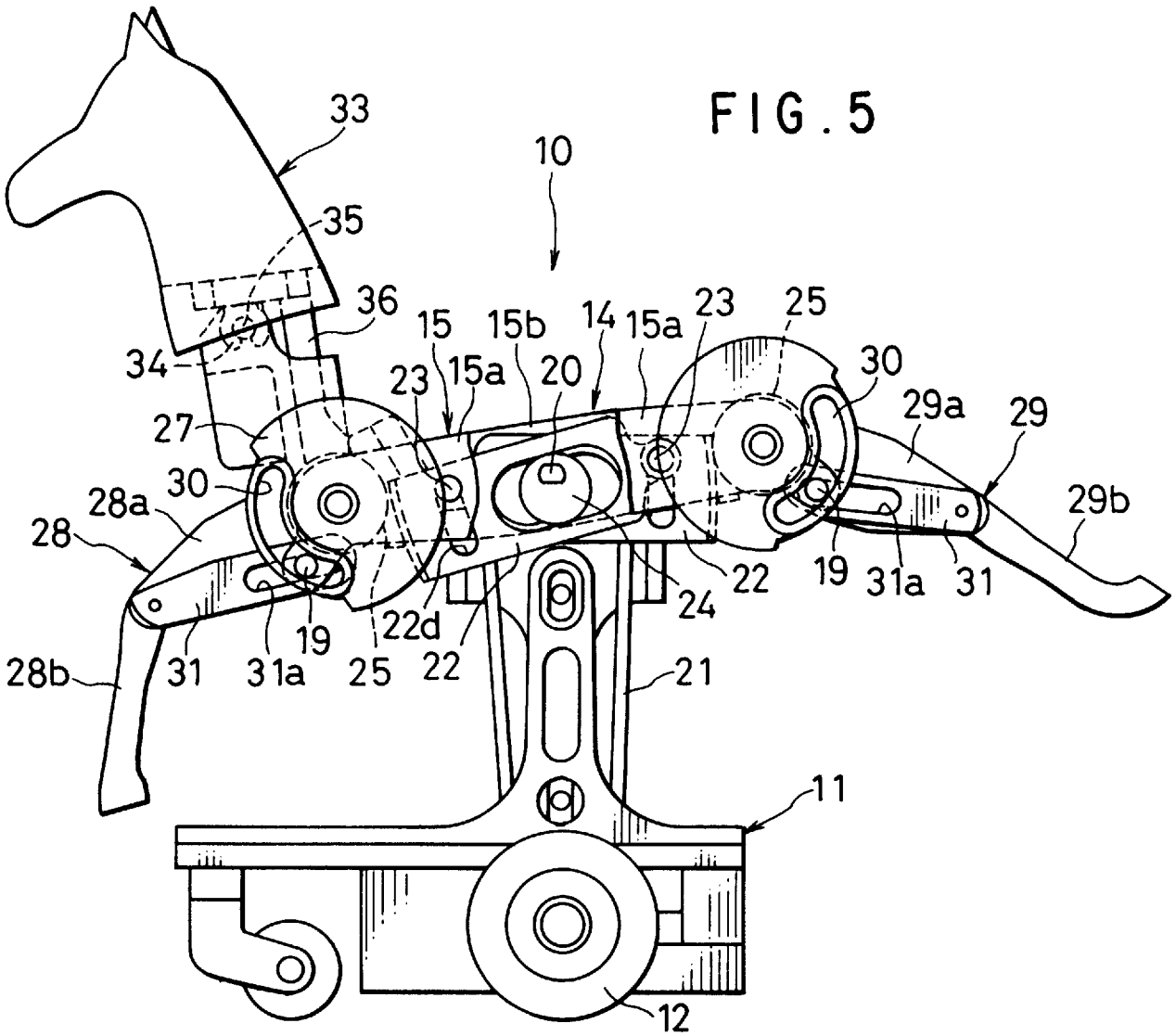
FIG. 5 is a side elevational view showing the manner in which the movable model object shown in FIG. 2 operates when the movable model object runs on a field of the horse racing game apparatus.

An arm 36 is attached to the lower end of the head 33 and has a lower end held in sliding engagement with a tip end of a lever 37 extending upwardly from an upper edge of one of the sector plates 22. When the sector plate 22 from which the lever 37 extends is angularly moved to tilt the lever 37 forward, the lever 37 pushes forward the lower end of the arm 36 for thereby turning the head 33 clockwise about the support shaft 35 from a tilted position (FIG. 1) to a raised position (FIG. 5).

The head 33 is constructed such that its center of gravity is positioned forward of the support shaft 35. Therefore, when the lever 37 is tilted backward to release the arm 36, the head 33 is tilted forward, i.e., turned counterclockwise, due to gravity. Consequently, the head 33 is swung back and forth when the sector plates 33 are angularly moved.

Operation of the movable model object 10 will be described below. The movable model object 10 on the field 1 (see FIG. 1) moves under attractive forces produced by a magnet (not shown) that moves along the lower surface of the field 1. When the movable model object 10 moves on the field 1, the wheels 12 supported on the base 11 and held in rolling contact with the field 1 also rotate. The rotation of the wheels 12 causes the wheel shaft 12*a* to rotate, enabling the endless belt 21 to rotate the rotatable shaft 20 that is supported by the fixed frame 15.

Upon rotation of the rotatable shaft 20, the four eccentric cam disks 24 in the openings 22*c* are rotated, swinging the sector plates 22. When the sector plates 22 are angularly moved, the gears 25 meshing with the respective arcuate racks 22*b* on sector plates 22 are angularly moved back and forth about the shafts 26.

As shown in FIG. 5, the disks 27 that are connected to the respective gears 25 by the shafts 26 are also angularly moved back and forth, causing the upper leg members 28*a*, 29*a* to turn about the shafts 26. The swinging movement of the upper leg members 28*a*, 29*a* causes their lower ends pivotally connected to the lower leg members 28*b*, 29*b* to move back and forth along arcs about the shafts 26.

Since the pins 19 fixed to the side plates 15*a*, 15*b* in spaced relation to the shafts 26 about which the upper leg members 28*a*, 29*a* are angularly movable are received in the slots 31*a* in the upper end portions of the lower leg member operating links 31, the lower leg member operating links 31 are angularly moved about the pivot shafts 28*c*, 29*c* with respect to the upper leg members 28*a*, 29*a* as the pins 19 slide along inner edges of the slots 31*a*.

When the lower leg member operating links 31 are angularly moved about the pivot shafts 28*c*, 29*c* with respect to the upper leg members 28*a*, 29*a*, the lower leg members 28*b*, 29*b* are also angularly moved about the pivot shafts 28*c*, 29*c* with respect to the upper leg members 28*a*, 29*a*. As a consequence, the upper leg members 28*a*, 29*a* and the lower leg members 28*b*, 29*b* are angularly moved in a manner similar to actual horse's leg members. Therefore, the movable model object 10 moves in a fashion analogous to an actual horse when it runs.

Each time the lever 37 is tilted forward by the sector plate 22 on which it is mounted, the lower end of the arm 36 is pushed forward by the lever 37, raising the head 33. When the lower end of the arm 36 is released, the head 33 is tilted forward due to gravity. The head 33 is thus swung back and forth about the support shaft 35.

Therefore, when the movable model object 10 runs on the field 1, the front and rear legs 28, 29 swing and also their upper and lower leg portions 28*a*, 29*a* and 28*b*, 29*b* also swing relatively to each other, and the head 33 also swings in synchronism with the front and rear legs 28, 29. The movement of the movable model object 10 as it runs on the field 1 looks highly realistic like an actual racehorse to the eyes of the game player.

The timing of movement of the front and rear legs 28, 29 relative to each other and the timing of movement of left and right ones of the front and rear legs 28, 29 relative to each other can freely be selected and established by adjusting the angular displacements of the four eccentric cam disks 24 with respect to each other at the time the four eccentric cam disks 24 are attached to the rotatable shaft 20.

In the illustrated embodiment, the racks 22*b* and the gears 25 held in mesh therewith are employed to transmit angular movement of the sector plates 22 to the gears 25 and hence the disks 27. However, the ends of the sector plates 22 may be devoid of the racks 22*b* and may be held in frictional contact with the outer circumferential surfaces of rotatable bodies that may be used in place of the gears 25. Alternatively, pins may be mounted on either such rotatable bodies or the sector plates, and may be received in grooves defined in either the sector plates or the rotatable bodies.

In the above embodiment, the lower leg member operating links 31 are separate from the lower leg members 28*b*, 29*b* and pivotally connected to the lower leg members 28*b*, 29*b* by the pivot shafts 28*c*, 29*c*. However, the lower leg member operating links 31 and the lower leg members 28*b*, 29*b* may be integrally formed with each other in an angularly bent shape and may be pivotally connected at the bent corner to the lower ends of the upper leg members 28*a*, 29*a* by pins.

The model 14 of the illustrated movable model object 10 resembles a racehorse. However, the model 14 is not limited to a racehorse, but may be any of various other models having movable elements, such as a bicycle, an athlete, a car, a motorcycle, etc.

Since the endless belt 21 is used to transmit rotation from the wheels 12 to the rotatable shaft 20 for moving the movable elements, the movable model object 10 is free of the difficulty in selecting and establishing speed reduction ratios which would otherwise be required for movable model objects having many gears. Because movement of the endless belt 21 is less visually recognizable than gears, the movable model object 10 is relatively aesthetically pleasing to the eye.

The upper and lower leg members 28*a*, 29*a* and 28*b*, 29*b* of the front and rear legs 28, 29 are moved with respect to each other through the relatively simple structure which includes the pins 19 and the lower leg member operating links 31. Consequently, the upper and lower leg members 28*a*, 29*a* and 28*b*, 29*b* of the front and rear legs 28, 29 are moved highly reliably with respect to each other. The number of parts that make up the leg operating mechanism and hence the movable model object 10 is relatively small, can be assembled efficiently with relative ease, and can be manufactured relatively inexpensively.

Although a certain preferred embodiment of the present invention has been shown and described in detail, it should be understood that various changes and modifications may be made therein without departing from the scope of the appended claims.

What is claimed is:

1. A movable model object for use in a game having a field, comprising:

a base having at least one wheel movable on the field; and a model supported on said base, said model having a fixed frame, a rotatable shaft rotatably supported on said fixed frame, movable elements independently movably supported on said fixed frame, and a power transmitting mechanism for transmitting rotation of said wheel to said movable elements through said rotatable shaft;

said power transmitting mechanism comprising an endless belt for transmitting the rotation of said wheel to said rotatable shaft to move said movable elements;

said power transmitting mechanism further comprising at least one eccentric cam disk mounted on said rotatable shaft and at least one sector plate pivotally connected at an end thereof to said fixed frame and having an arcuate angular movement transmitting member at an opposite end thereof for transmitting angular movement to said movable elements, said eccentric cam disk being held in contact with said sector plate for angularly moving said sector plate to angularly move said movable elements in response to rotation of said rotatable shaft.

2. A movable model object according to claim 1, wherein said model is analogous in shape to an animal, each of said movable elements comprising front and rear legs of the animal, each of said front and rear legs having an upper leg member and a lower leg member pivotally connected to a lower end of said upper leg member, said movable model object further comprising a leg operating mechanism for moving the upper leg members and the lower leg members of the front and rear legs, said leg operating mechanism comprising a rotatable body connected to an upper end of each of said upper leg members and angularly movable back and forth through a predetermined angular range in response to the rotation transmitted by said power transmitting mechanism, a lower leg member operating link connected to an upper end of each of said lower leg members, and a joint operatively connecting an upper end of said lower leg member operating link to said fixed frame.

3. A movable model object according to claim 2, wherein said joint comprises a slot defined in said lower leg member operating link and a pin mounted on said fixed frame and inserted in said slot, said pin being spaced from an axis about which said upper leg member is angularly movable.

4. A movable model object for use in a game having a field, comprising:

a base having at least one wheel movable on the field;

a model supported on said base, said model having a fixed frame, a rotatable shaft rotatably supported on said fixed frame, movable elements independently movably supported on said fixed frame, and a power transmitting mechanism for transmitting rotation of said wheel to said movable elements through said rotatable shaft, said power transmitting mechanism comprising an endless belt for transmitting the rotation of said wheel to said rotatable shaft to move said movable elements; and a movable element operating mechanism for operating the moveable elements in response to the rotation transmitted by said power transmitting mechanism, each of said moveable elements including a first moveable element part and a second moveable element part pivotably mounted on said first moveable elements part, said moveable element operating mechanism comprising a rotatable body connected to an upper end of each of said first movable element parts and angularly movable back and forth through a predetermined angular range in response to the rotation transmitted by said power transmitting mechanism, a movable element operating link fixedly connected to each of said second movable element parts, and a joint operatively connecting said operating link to said fixed frame.

5. A movable model object according to claim 4, wherein said joint comprises a slot defined in said operating link and a pin mounted on said fixed frame and inserted in said slot, said pin being spaced from an axis about which said rotatable body is rotatable.

6. A movable model object for use in a game comprising:

a base;

a model supported on said base, said model having a fixed frame, a rotatable shaft rotatably supported on said fixed frame, movable elements independently movably supported on said fixed frame, and a power transmitting mechanism for transmitting rotation of said movable elements through said rotatable shaft;

said power transmitting mechanism comprising at least one eccentric cam mounted on said rotatable shaft and at least one sector pivotally connected to said fixed frame, said sector having an arcuate angular movement transmitting part for transmitting angular movement to said movable elements, said eccentric cam being in contact with said sector for angularly moving said sector to angularly move said movable elements in response to rotation of said rotatable shaft.

7. A movable model object for use in a game comprising:

a base;

a model supported on said base, said model having a frame, a rotatable shaft rotatably supported on said frame, movable elements independently movably supported on said frame, a power transmitting mechanism for transmitting rotation of said rotatable shaft to said movable elements;

a movable element operating mechanism for operating the movable elements in response to the rotation transmitted by said power transmitting mechanism, each of said moveable elements including a first moveable element part and a second moveable element part, said movable element operating mechanism comprising a rotatable body connected to an upper end of each of said first movable element parts and angularly movable back and forth through a predetermined angular range in response to the rotation transmitted by said power transmitting mechanism, a movable element operating link fixedly connected to said first movable element part, and a joint operatively connecting said operating link to said fixed frame.

8. A movable model object according to claim 7, wherein said joint comprises a slot in said operating link and a pin mounted on said fixed frame and inserted in said slot, said pin being spaced from an axis about which said rotatable body is rotatable.

9. A movable model object according to claim 7, wherein each of said first moveable element parts is pivotably mounted on said frame for pivoting about a pivotable axis, each of said first moveable element parts having a partial circular slot uniformly spaced from a center which coincides with the respective pivotal axis of each first moveable element part.

10. A movable model object according to claim 9, wherein said pivotal axis is designated a first pivotal axis, said second moveable element part being pivotably mounted on said first moveable element part for pivotal movement about a second pivotal axis, said operating link being pivotably mounted on said first moveable element part for pivotal movement about said second pivotal axis.

11. A movable model object according to claim 7, wherein said second moveable element part is fixed to said operating link.

12. A moveable model object for use in a game comprising:

a frame;

at least one moveable element pivotably mounted on said frame for pivotal movement about a first pivotal axis;

at least one other movable element pivotably mounted on said at least one moveable element for pivotable movement about a second pivotal axis;

an operating link fixed to said at least one other moveable element;

an oscillating mechanism for oscillating said at least one moveable element about said first pivotal axis; and an operable connection spaced from said first and second pivotal axes operably connecting said operating link to said frame.

13. A moveable model object according to claim 12 wherein said operable connection includes a slot in said operating link, and a pin fixed to said frame, said pin being received in said slot.

14. A moveable model object according to claim 13 wherein said slot is a generally linear slot.

15. A moveable model object according to claim 13 wherein said slot in said operating link is designated a first slot, and further comprising a second slot in said at least one moveable element, said pin being received in said second slot.

16. A moveable model object according to claim 15 wherein said second slot is a partial circular slot uniformly spaced from a center which is coincident with said first pivotal axis.

17. A moveable model object according to claim 12 wherein said at least one other moveable element and said operating link are fixed to one another at said second pivotal axis.

18. A moveable model object for use in a game comprising:

a frame;

at least one moveable element pivotably mounted on said frame for pivotal movement about a first pivotal axis;

at least one other moveable element pivotably mounted on said at least one moveable element for pivotable movement about a second pivotal axis;

an oscillating mechanism for oscillating said at least one moveable element about said first pivotal axis;

an operable connection spaced from said first and second pivotal axes for effecting transmission of the oscillation of said at least one moveable element to said at least one other moveable element;

said at least one moveable element having a first circular engageable part uniformly spaced from a center which is coincident with said first pivotal axis, said oscillating mechanism including an oscillating sector member pivotably mounted on said frame for pivotal movement about a third pivotal axis, said oscillating sector member having a second circular engageable part uniformly spaced from a center which is coincident with said third pivotal axis, said second circular engageable part engaging said first circular engageable part for transmitting oscillating motion of said oscillating sector member to said at least one moveable element.

19. A moveable model object according to claim 18 wherein said at least one moveable element is designated a first moveable element and said at least one other moveable element is designated a second moveable element, said oscillating sector member being designated a first oscillating sector member, further comprising a third moveable element pivotably mounted on said frame for pivotable movement about a fourth pivotal axis, said third moveable element having a third circular engageable part uniformly spaced from a center which is coincident with said fourth pivotal axis, further comprising a second oscillating sector member pivotably mounted on said frame for pivotable movement about a fifth pivotable axis, said second oscillating sector member having a fourth circular engageable part uniformly spaced from a center which is coincident with said fifth pivotal axis, said fourth circular engageable part engaging said third circular engageable part for transmitting oscillating motion of said second oscillating sector member to said third moveable element.

20. A moveable model object according to claim 19 wherein said first oscillating sector member has a first partial circular slot uniformly spaced from a center which, is coincident with said third pivotal axis, said second oscillating sector member having a second partial circular slot uniformly spaced from a center coincident with said fifth pivotal axis, a first pivot support pivotably supporting said first oscillating sector member on said frame for pivotal movement about said third pivotal axis, said first pivotal support being received in said second partial circular slot in said second oscillating sector member, a second pivot support pivotable supporting said second oscillating sector member on said frame for pivotal movement about said fifth pivotal axis, said second pivotal support being received in said first partial circular slot in said first oscillating sector member.

21. A moveable model object according to claim 20 wherein said oscillating mechanism includes a first cam for oscillating said first sector member and a second cam for oscillating said second sector member.

22. A moveable model object according to claim 21 wherein said first and second cams rotate about a common cam axis.

* * * * *